US006984197B2

(12) United States Patent
Sugiyama et al.

(10) Patent No.: US 6,984,197 B2
(45) Date of Patent: Jan. 10, 2006

(54) EXERCISE APPARATUS

(75) Inventors: Toshihide Sugiyama, Shizuoka (JP); Shuzo Ishihara, Shizuoka (JP)

(73) Assignee: Skylite Corporation, Shizuoka (JP)

( * ) Notice: Subject to any disclaimer, the term of this patent is extended or adjusted under 35 U.S.C. 154(b) by 172 days.

(21) Appl. No.: 10/306,180

(22) Filed: Nov. 27, 2002

(65) Prior Publication Data

US 2004/0005972 A1 Jan. 8, 2004

(30) Foreign Application Priority Data

Jul. 8, 2002 (JP) ..... 2002-198254

(51) Int. Cl.
*A63B 71/00* (2006.01)

(52) U.S. Cl. ..... 482/148; 601/5; 601/26; 601/27; 601/35

(58) Field of Classification Search ..... 482/148; 601/5, 26–27, 35; 446/220
See application file for complete search history.

(56) References Cited

U.S. PATENT DOCUMENTS 695,538 A * 3/1902 Clairmont ..... 482/145
4,242,265 A * 12/1980 Wade et al. ..... 548/455
4,795,148 A * 1/1989 Rangaswamy ..... 482/80
4,856,844 A * 8/1989 Isono ..... 297/284.6
5,087,036 A 2/1992 Cooper
5,230,249 A * 7/1993 Sasaki et al. ..... 73/714
5,416,939 A * 5/1995 Maalouli ..... 5/610
5,417,644 A 5/1995 Lee
5,421,801 A 6/1995 Davis, III et al.
5,423,136 A * 6/1995 Gulli ..... 36/132
5,752,330 A 5/1998 Snabb
5,784,806 A 7/1998 Wendt
6,030,352 A 2/2000 Paik
2004/0034314 A1 * 2/2004 Kobayashi

* cited by examiner

*Primary Examiner*—Gregory L. Huson
*Assistant Examiner*—L. Amerson
(74) *Attorney, Agent, or Firm*—Muramatsu & Associates

(57) ABSTRACT

An exercise apparatus for applying desired stretch exercises while a user is sitting down on a chair or laying on his back. The exercise apparatus includes a portable frame, a leg supporting bag for fixedly supporting the legs of the user in the frame, and a sole pressing bag for pressing the soles of the user in the direction stretching the Achilles tendons. When the legs are fixed by the leg supporting bag, the soles of the user are pressed by inflating bags formed in the frame to stretch the Achilles tendons. The user can enjoy desired degrees of stretch exercises as well as massage on his legs.

12 Claims, 10 Drawing Sheets

EXERCISE APPARATUS

FIELD OF THE INVENTION

The present invention relates to an exercise apparatus for stretching the legs below the knees, and more particularly, to an exercise apparatus which is capable of applying pressure to the soles in the direction of stretching the Achilles tendons to stretch the legs below the knees as well as massage them.

BACKGROUND OF THE INVENTION

The exercise apparatus in the conventional technology is known to stretch, for example, the legs below the knees, especially the Achilles tendons. Typically, such an apparatus has a sloped board where a user stands thereon so that his toes are raised in an upward position relative to his heels, hence stretching his Achilles tendons.

However, the structure of the conventional exercise apparatus has the following problems. A user has to stand on the sloped board of the exercise apparatus to use his weight to stretch his Achilles tendons, thus, the user cannot use this apparatus while sitting on a chair or lying on the floor. Further, the sloped board enables the user only to stretch the Achilles tendons, and is not possible to provide other effects, for example, massaging the legs at the same time.

SUMMARY OF THE INVENTION

Therefore, it is an object of the present invention to provide an exercise apparatus which is capable of executing desired stretch exercises on the legs below the knees while sitting on a chair or lying on the back.

It is another object of the present invention to provide an exercise apparatus which is capable of executing stretch exercises as well as massage on the legs below the knees at the same time.

It is a further object of the present invention to provide an exercise apparatus which is capable of freely changing the degree of stretching effects or increasing the angle of pressing the toes.

In order to achieve the above objects, the exercise apparatus in the first aspect of the present invention is comprised of a frame, a leg supporting means provided on the frame for fixedly supporting the legs below the knees of a user, and a sole pressing means provided on the frame for applying pressure to the soles of the user, thereby stretching the Achilles tendons.

Further, in the exercise apparatus in the second aspect of the present invention, the leg supporting means fixedly supports the legs under knees by selectively supplying and releasing fluid for the bags.

Further, in the exercise apparatus in the third aspect of the present invention, the leg supporting means fixedly supports the legs under knees by inflating air bags by fluid.

Further, in the exercise apparatus in the fourth aspect of the present invention, the leg supporting means is structured to fixedly support ankles and calves of the user.

Further, in the exercise apparatus in the fifth aspect of the present invention, the leg supporting means is provided with a pressing means for applying pressure to the calves from the bottom.

Further, in the exercise apparatus in the sixth aspect of the present invention, the sole pressing means applies the pressure to the soles by selectively supplying and releasing the fluid for the bags.

Further, in the exercise apparatus in the seventh aspect of the present invention, the sole pressing means applies the pressure to the soles by using the air bags.

Further, in the exercise apparatus in the eighth aspect of the present invention, a plurality of bags or air bags are piled or aligned together.

Further, in the exercise apparatus in the ninth aspect of the present invention, the surfaces of the bags or air bags are provided with protrusions to stimulate the therapeutic points.

Further, in the exercise apparatus in the tenth aspect of the present invention, the leg supporting means and the sole pressing means are so configured to accommodate both legs under knees.

Further, in the exercise apparatus in the eleventh aspect of the present invention, the height of the frame contacting the feet is adjustable.

Further, in the exercise apparatus in the twelfth aspect of the present invention, a vertical angle of the sole pressing means is adjustable.

Further, the exercise apparatus in the thirteenth aspect of the present invention further includes control means for controlling the leg supporting means and the sole pressing means, and input means for entering various conditions in the control means.

Therefore, in the exercise apparatus of the present invention, the leg supporting means fixedly supports the legs under knees, and under that condition, the sole pressing means applies pressure to the soles to stretch the Achilles tendons of the user. Accordingly, the user can enjoy desired stretch exercises while sitting on a chair or lying on his back. In addition, a massage effect can be achieved by the leg supporting means by repeatedly applying or releasing the pressure to the legs.

Preferably, the leg supporting means fixedly supports the lets under knees by, for example, selectively supplying the compressed fluid to the bags in the predetermined order. More specifically, the legs of the user are stabilized by air bags. The leg supporting means also stabilizes the ankles and calves with a pressing means that is provided to apply pressure to the ankles and calves from the bottom.

Preferably, the sole pressing means applies the pressure to the soles by selectively supplying the compressed fluid to the bags under the soles. More specifically, the sole pressing means applies the pressure to the soles through the air bags.

Preferably, a plurality of bags or air bags are piled together to increase the degree of pressing the feet. Further, the surfaces of such bags or air bags are preferably provided with projections or bumps to stimulate the therapeutic points of the feet.

Preferably, the leg supporting means and the sole pressing means are structured to accommodate both legs of the user. Preferably, the height (angle) of the frame which contacts with the sole is adjustable. By increasing the height of the frame at the sole, the pressure from the sole pressing means applied to the soles further increases.

Further, the vertical angle of the sole pressing means is structured to be adjustable. By changing the vertical angle toward the soles, the pressure from the sole pressing means further increases.

The excise apparatus further includes the control means for controlling the operation of the feet supporting means and the sole pressing means, and an input means such as control buttons for supplying various operating conditions to the control means.

BRIEF DESCRIPTION OF THE DRAWINGS

FIG. 4A shows a sole support plate which is structured in a rotatable manner, and FIG. 4B shows the rotatable sole support plate as shown in FIG. 4A in addition to a bottom frame having means for adjusting the height thereof.

FIG. 6A shows the range of movement by the pressure when two air bags are piled together, and FIG. 6B shows the range of movement when one air bag is incorporated.

FIG. 10A is a plan view of the air bag, and FIG. 10B is the side view of the air bag.

PREFERRED EMBODIMENTS OF THE INVENTION

Figure 1:
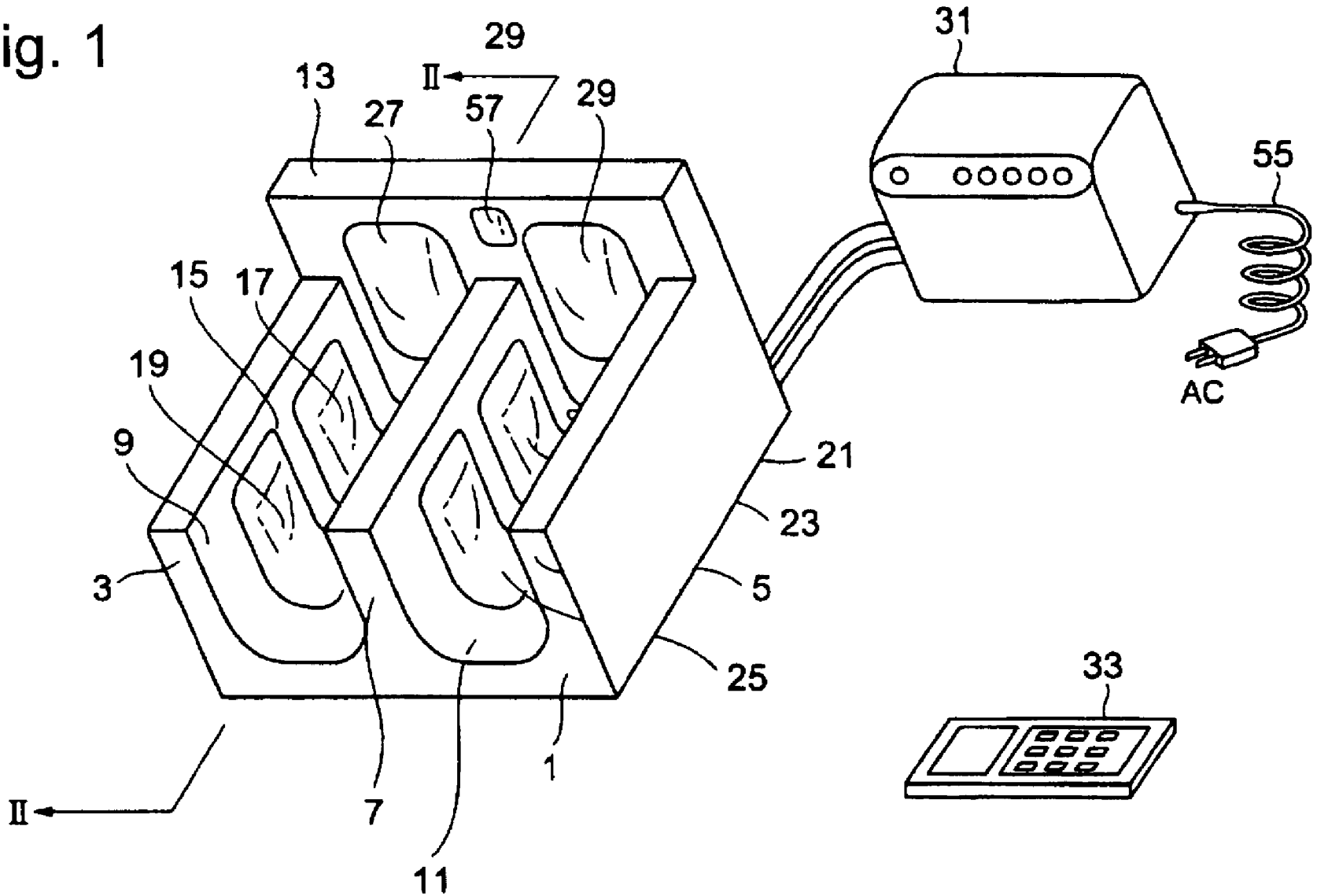
FIG. 1 is a perspective view showing the entire structure of the exercise apparatus in the first embodiment of the present invention.
Figure 2:
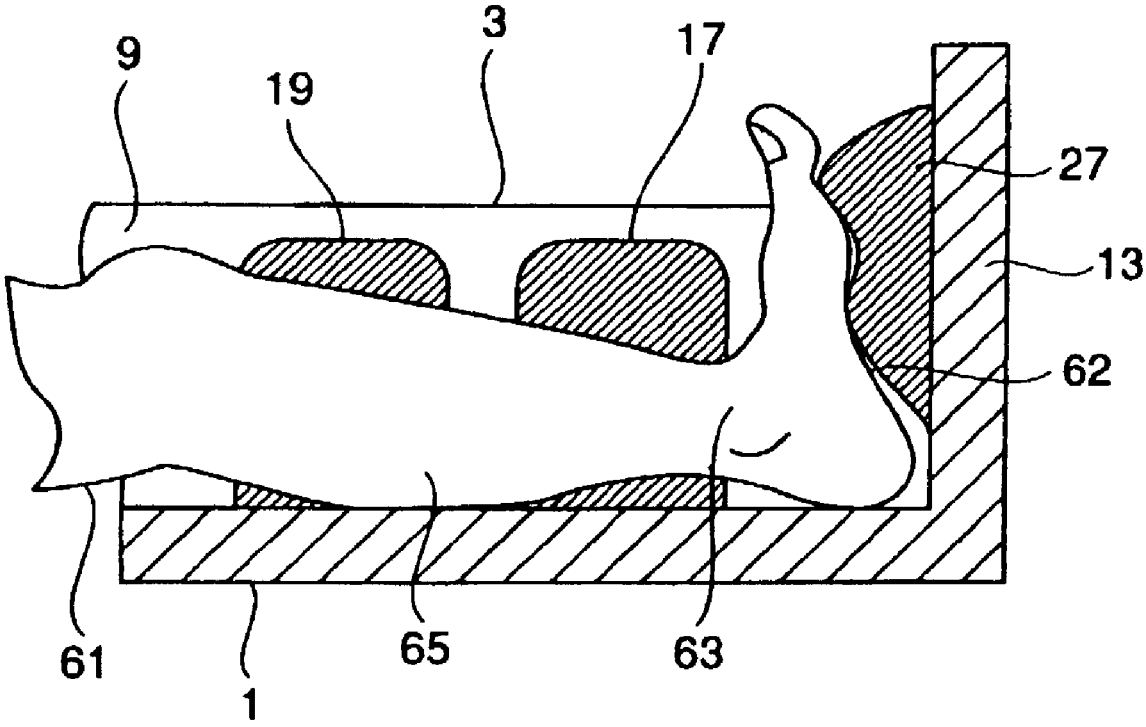
FIG. 2 is a cross sectional view of the exercise apparatus in the first embodiment of the present invention taken along the II—II line of FIG. 1.
Figure 3:
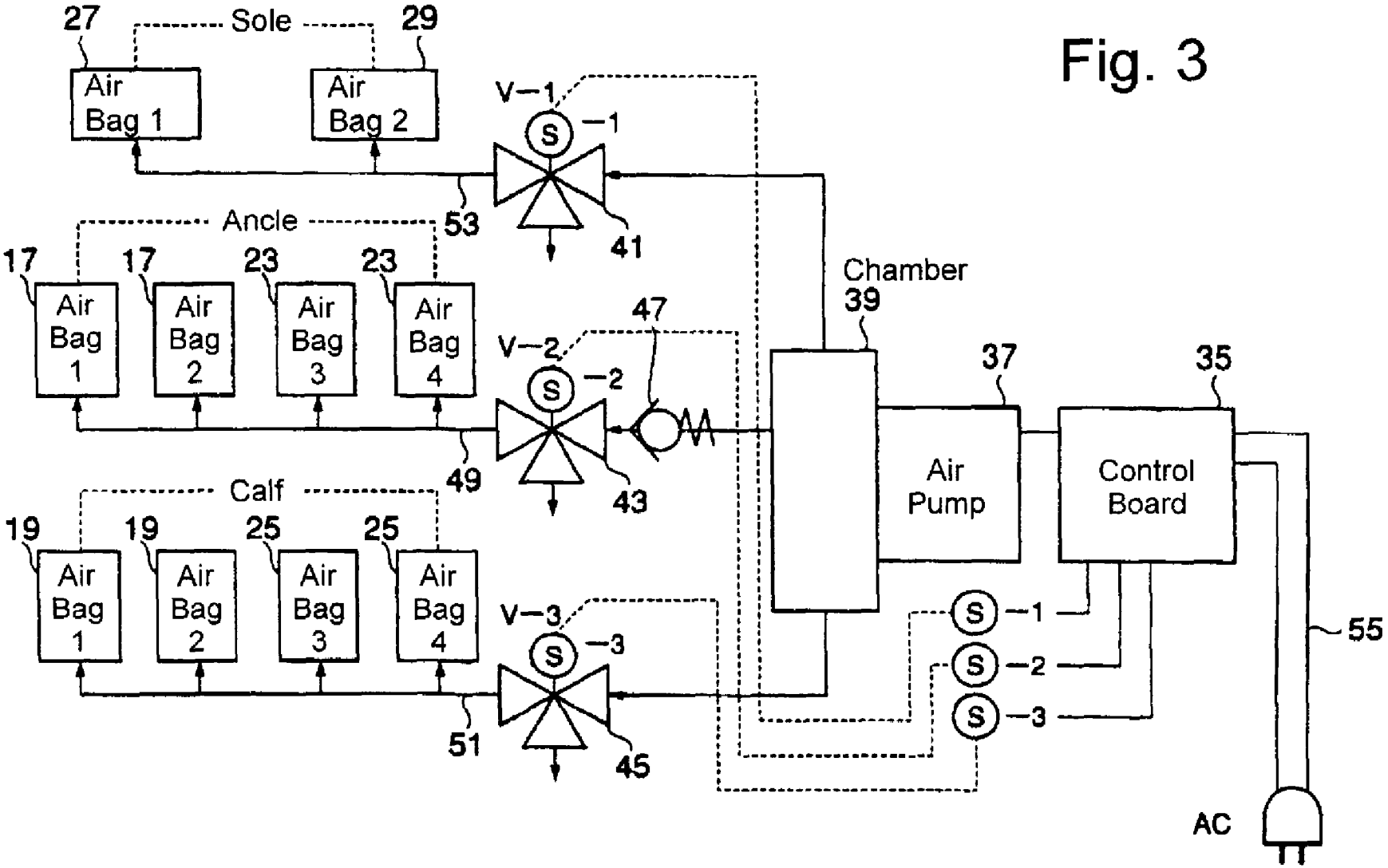
FIG. 3 is a block diagram showing the electric and air circuit structure of the exercise apparatus in the first embodiment of the present invention including a plurality of air bags.

The exercise apparatus in the first embodiment of the present invention will be explained below with reference to FIGS. 1–3. FIG. 1 is a perspective view of the entire structure of the exercise apparatus of the present invention and FIG. 2 is a cross sectional view of the exercise apparatus. The exercise apparatus is generally configured by a portable frame 1 and a controller box 31. The portable frame 1 can be carried around anywhere and is comprised of a left side wall 3, a right side wall 5, and a partition wall 7. The left leg receiving unit 9 is formed between the left side wall 3 and the partition wall 7, and similarly, a right leg receiving unit 11 is formed between the right side wall 5 and the partition wall 7. The frame 1 further includes a sole support wall 13 to contact both left and right soles of the user.

A leg supporting means 15 is provided within the left leg receiving unit 9. The leg supporting means 15 is comprised of a pair of ankle stabilizing air bags 17 and a pair of calf stabilizing air bags 19. For simplicity of illustration, FIG. 1 only shows one ankle stabilizing air bag 17 and one calf stabilizing air bag 19, although two or more air bags may be used for achieving an improved performance.

Similarly, a leg supporting means 21 is provided within the right leg receiving unit 11. The leg supporting means 21 is comprised of a pair of ankle stabilizing air bags 23 and a pair of calf stabilizing air bags 25. For simplicity of illustration, FIG. 1 only shows one ankle stabilizing air bag 23 and one calf stabilizing air bag 25, although two or more air bags may be used for achieving an improved performance.

The exercise apparatus further includes sole pressing air bags 27 and 29 which are provided on the inner surface of the sole support wall 13, thereby forming a sole pressing means. Further, in this example, a controller box 31 and a remote controller 33 are provided separately from the frame 1. The controller box 31 has a power cable 55 to receive an electric power, such as a commercial AC power to operate the exercise apparatus.

Next, the entire structure including the air circuit and the electric circuit in the exercise apparatus of the present invention will be explained with reference to the block diagram of FIG. 3. The controller box 31 (FIG. 1) is comprised of, for example, a controller circuit board 35, an air pump 37, an air chamber 39, and three-way solenoid valves 41, 43, and 45. A check valve 47 is provided between the three-way solenoid valve 43 and the air chamber 39. The pair of air bags 17, the pair of air bags 23, the three-way solenoid valve 43, and the check valve 47 are connected together through an air pipe 49. Similarly, the pair of air bags 19, the pair of air bags 25, and the three-way solenoid valve 45 are connected together through an air pipe 51. Further, the air bags 27 and 29, and the three-way solenoid valve 41 are connected together through an air pipe 53. Each air bag is, for example, made of nylon or polyurethane resin, and is provided with an external cover made of polyester.

The power cable 55 with a power plug is connected to controller circuit board 35. In the example of FIG. 1, a signal receiver 57 is provided at the center on the inner side of the sole support plate 13 for receiving control signals from the remote controller 33. The controller circuit board 35 in FIG. 3 is provided with a timer circuit (not shown) to set the stretch times through the remote controller 33. By selecting the automatic drive mode, the exercise apparatus operates for 15 minutes, for example, and then automatically stops.

Next, the operation of the exercise apparatus having the structure noted above will be explained below. FIG. 2 is a cross sectional view of the exercise apparatus in the first embodiment of the present invention taken along II—II line of FIG. 1. The user, while lying on the back, will place his/her left and right legs 61 in the left leg receiving unit 9 and the right leg receiving unit 11, respectively, until each of his sole 62 contact with the inner surface of the sole support wall 13. FIG. 2 shows only the left leg under knee for simplicity of illustration, although both legs may be preferably exercised at the same time.

Under this condition, the user can start the exercise by operating the remote controller 33. As an example, programs for all functions are pre-installed in the controller so that various operations are performed automatically, and after the predetermined time length such as fifteen minutes, the exercise apparatus automatically stops.

When the exercise apparatus is turned on, the air pump 37 will activate and the three-way solenoid valve 43 will open to supply the compressed air to the pair of air bags 17 and to the pair of air bags 23. As a result, the air bags 17 and 23 will inflate around the left and right ankles 63 of the user to fix the legs in the leg receiving units of the exercise apparatus.

Next, the three-way solenoid valve 45 will open and supply the compressed air to the pair of air bags 19 and the pair of air bags 25. As a result, the air bags 19 and 25 will inflate around the left and right calves 65 of the user to further fix the legs. Accordingly, both legs 61 are sufficiently stabilized at this point in the exercise apparatus.

Then, the three-way solenoid valve 41 will open and supply the compressed air to the air bags 27 and 29 on the sole support wall (plate) 13. These air bags 27 and 29 will then inflate and apply pressure to the left and right soles 62 of the user, to press the toes, thereby stretching the Achilles tendons.

This condition will continue for a predetermined time such as several seconds to several ten seconds and then release the air from the inflated state of the bags. Namely, the three-way solenoid valve 41 will switch to the exhaust side to release the air from the air bags 27 and 29, which will relieve the pressure from the soles 62. Then, the three-way solenoid valve 45 will switch to the exhaust side to release the air from the inflated air bags 19 and 25, which will relieve the pressure from the calves 65. Finally, the three-way solenoid valve 43 will switch to the exhaust side to release the air from the inflated air bags 17 and 23, which will relieve the pressure from the ankles 63.

After a predetermined relax time, the above process of inflating the air bags will be started again. By repeating this operation, the stretch and massage exercises will be applied for a desired time length such as 15 minutes. The time and frequency of operation can be freely set through the remote controller 33. The entire operation can also be conducted automatically by the programs stored in the exercise apparatus or manually by setting the remote controller 33.

Based on the exercise apparatus in the present invention explained above, the following effects are achieved. The user is able to stretch his Achilles tendons while sitting on a chair or lying on the back. The user is also able to massage his ankles 63 and calves 65, which is combined with the stretch exercises for the Achilles tendons, thereby achieving greater stretch results.

Further, since this method using the air bags is able to absorb any difference in width and/or length of feet, any user can achieve great stretch and massage results. In the first embodiment, since the exercise apparatus is able to perform stretch exercises to both legs at the same time, efficient stretch results can be achieved.

When fixedly supporting the legs 61 at the ankles 63 and calves 65 separately, preferably, the ankles 63 are stabilized first. As shown in FIG. 2, the air bags 17 have a larger area over the ankle 63, thus, the pressure from the air bags is applied to an upper part of each ankle 63, which is effectively fix the ankle in the exercise apparatus while the sole is contacting the sole support wall 13. Accordingly, when the air bags 27 on the sole support wall 13 inflate in such a way to press the toes backward (in the left direction of FIG. 2), significant stretch effects can be achieved.

Figure 4A:
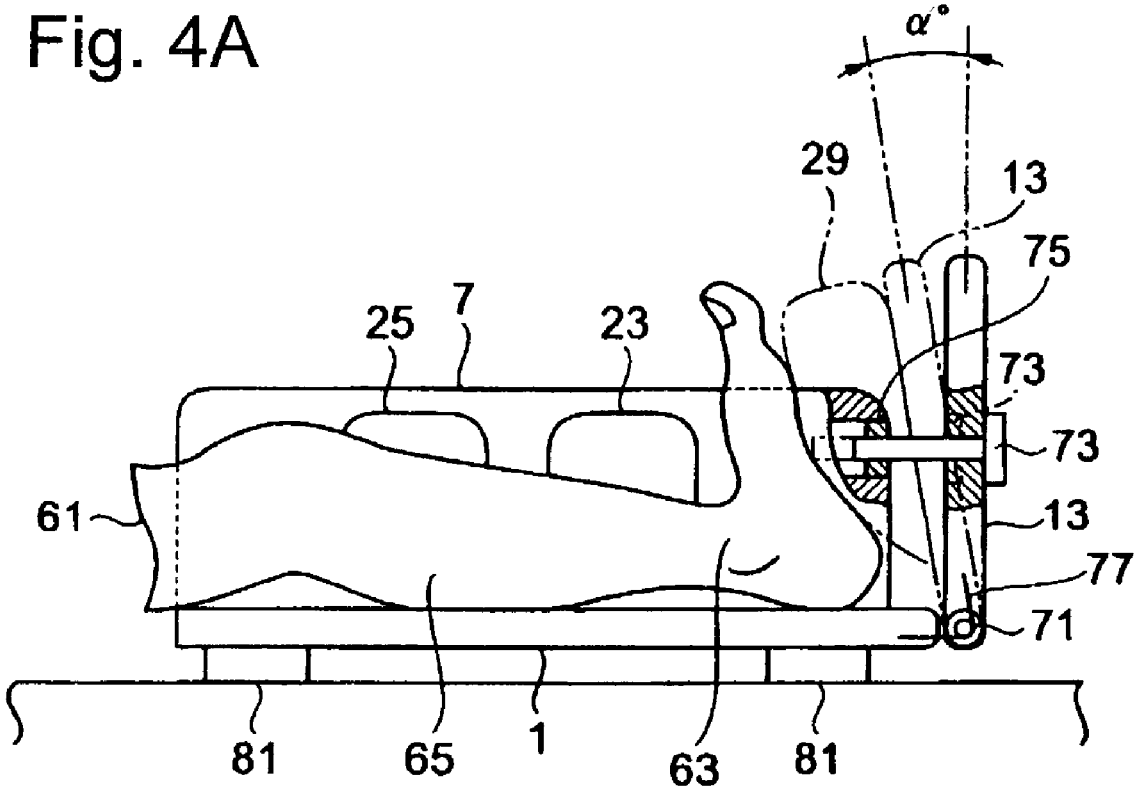
FIGS. 4A and 4B are cross sectional diagrams showing the exercise apparatus in the second embodiment of the present invention, where

The exercise apparatus in the second embodiment of the present invention will be explained with reference to FIGS. 4A and 4B. In FIG. 4A, the sole support wall 13 is attached to the frame 1 through a hinge 71 in a rotational manner. Further, the sole support wall 13 has a bolt 73 inserted therethrough, where the end of that bolt 73 is tightened to a nut 75 provided on the inner side of the frame 1 such as on the partition wall 7. A spring 77 is attached to the rotation shaft of the hinge 71 of the sole support wall 13 in a manner to bias the sole support wall 13 in a clockwise direction.

According to the above structure of the exercise apparatus in the second embodiment, when the bolt 73 is screwed into the nut 75, the sole support wall 13 will move against the spring force of spring 77. Thus, the sole support wall 13 rotates in a counterclockwise direction by a rotating angle (vertical angle) $\alpha°$ as shown in FIGS. 4A and 4B. This will increase the pressure applied to the soles 62. The rotating angle $\alpha°$ of the sole support wall 13 can be set, for example, to about 10°. By this arrangement, it is possible to adjust the degree of pressure, i.e., a stretch distance applied to the soles 62 of the user.

Figure 4B:
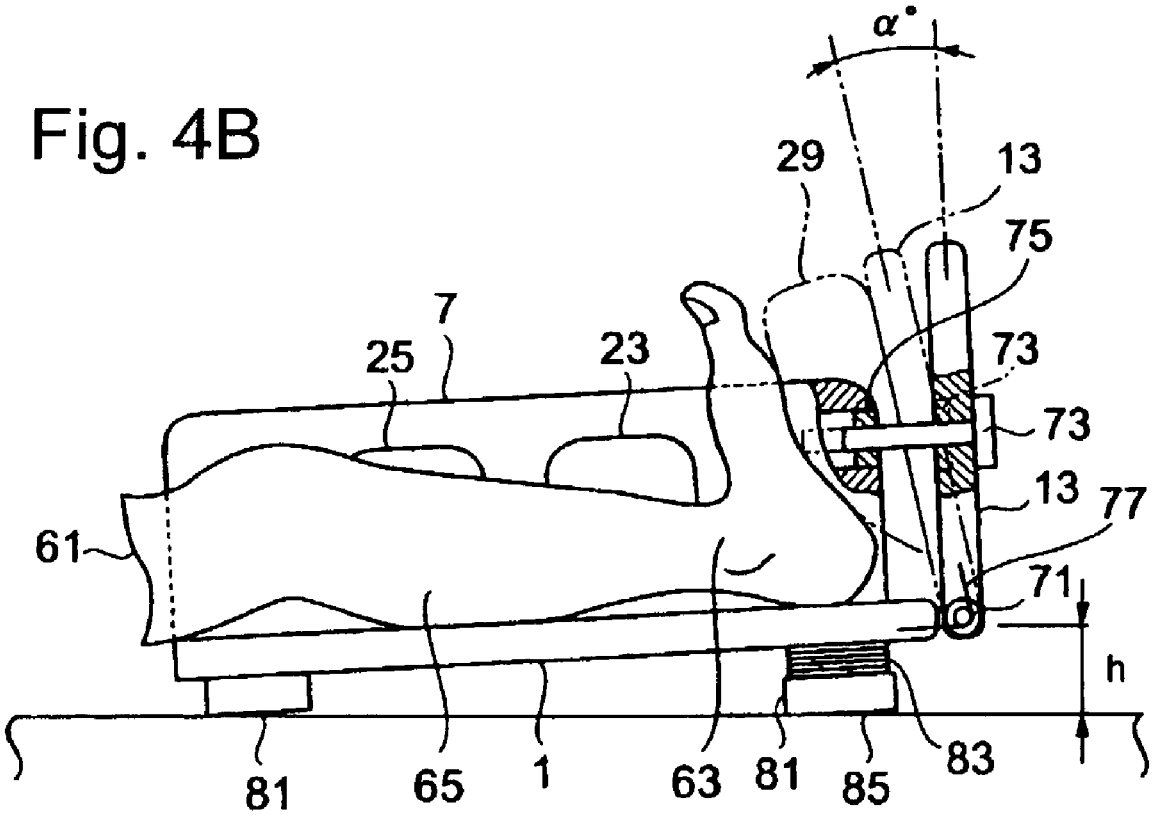

The example of FIG. 4B includes a further means for applying even stronger pressure to the soles 62. The structure shown in FIG. 4B is the same as that of FIG. 4A as to the rotational mechanism of the sole support wall 13. The example of FIG. 4B further includes a mechanism for adjusting the height of the frame 1 at the bottom thereof. Namely, legs 81 are attached to the bottom of the frame 1 at, for example, four locations. Two of the legs 81 provided at the area below the soles 62 are adjustable in the height by having screw mechanism. For example, female screws 85 are engaged with male screws 83, allowing the legs 81 to retract or extend upon the rotation of the female screws 85.

In order to apply more pressure to the soles 62 in the embodiment of FIG. 4B, the female screws 85 are rotated to expand the legs 81, which inclines the frame 1 as shown in the diagram. Thus, the height h at the end of the frame 1 increases, which will further increase the pressure applied to the soles 62. An example of adjustable range of the height h of the frame 1 is 20 mm.

Although the example of FIG. 4B includes all the structure shown FIG. 4A in addition to the height adjustment mechanism of the frame 1 noted above, a structure with only the height adjustment mechanism of the frame 1 can also be feasible.

Figure 5:
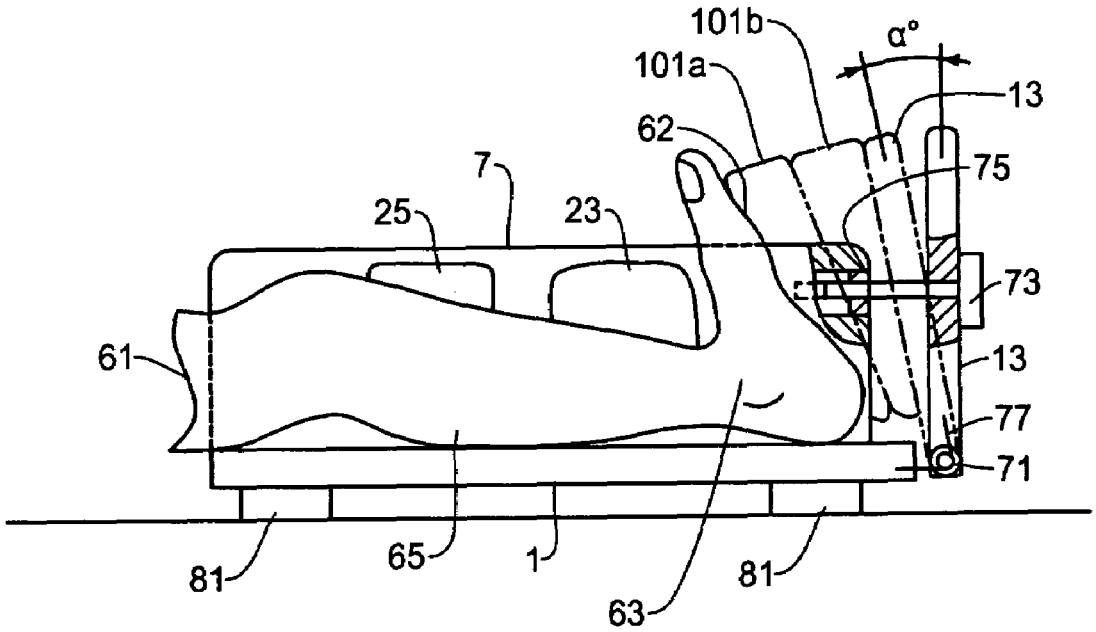
FIG. 5 is a cross sectional side view of the exercise apparatus in the third embodiment of the present invention.
Figure 6A:
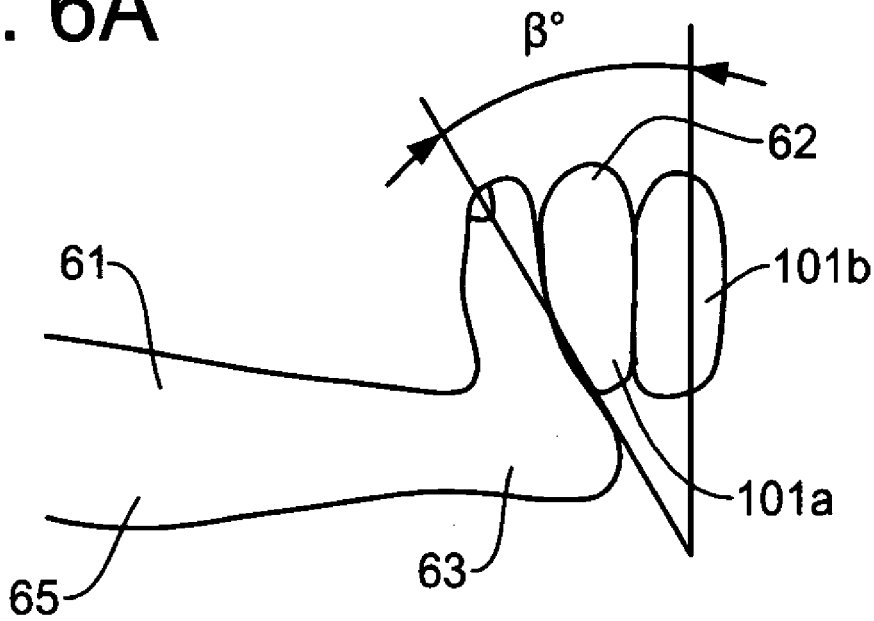
FIGS. 6A and 6B are schematic diagrams of the exercise apparatus in the third embodiment of the present invention, where

FIGS. 5 and 6A show the exercise apparatus in the third embodiment of the present invention. In the first and second embodiments in the foregoing, each of the sole pressing air bags 27 and 29 is configured by a single air bag. However, in the third embodiment, the sole pressing air bag is comprised of two air bags that are piled together. Namely, as shown in FIG. 5, an air bag 101*a* is mounted on an air bag 101*b* on the sole support wall 13. Each of the air bags 101*a* and 101*b* individually inflates or deflates, i.e, it is provided with a separate air pipe and valve from one another.

The other structure of this embodiment is the same as that of the second embodiment, and therefore, the same reference numerals are used for denoting the same elements of the exercise apparatus and the explanation of such elements will be omitted.

Figure 6B:
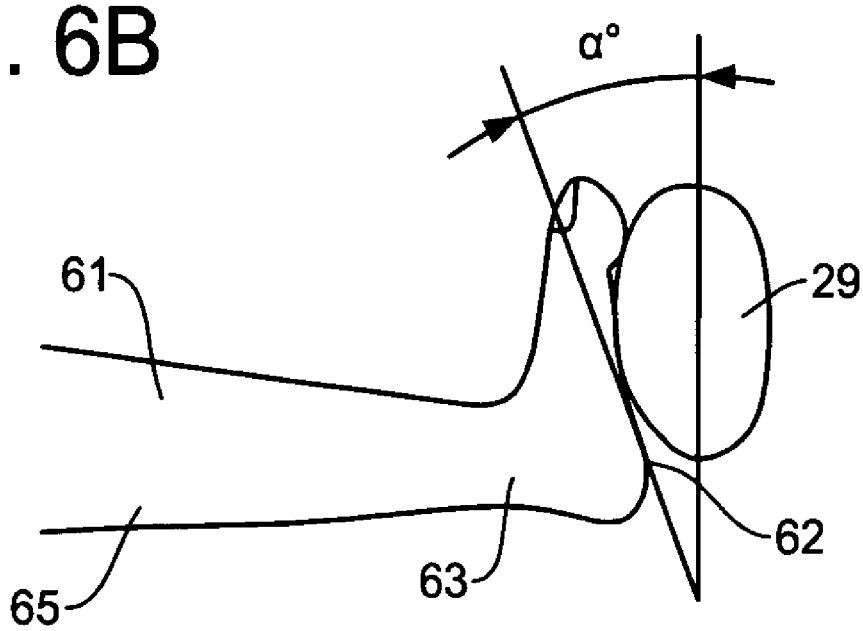

According to the above structure, as shown in FIG. 6A, a range of movement of the sole, i.e., an angle $\beta°$ is substantially increased from the example using only one air bag shown in FIG. 6B having the angle of $\alpha°$. Thus, in the third embodiment, the range of pressing the sole is remarkably increased from the angle $\alpha°$ (FIG. 6B) to the angle $\beta°$ (FIG. 6A), thereby further increasing the stretch effects.

Although the diagrams show the air bags pressing against only one sole, the same structure is also used for the other sole as well. Thus, the both soles receive additional pressure and angle for stretching the Achilles tendons. In the example of FIGS. 5 and 6A, although two air bags are piled together, three or more air bags can also be used to increase the stretch effects.

As in the foregoing, in the third embodiment, the range of pressing the sole is further increased, which allows the exercise apparatus to accommodate various needs and conditions of users. Also, the exercise apparatus of the present invention is able to apply simple yet effective stretch exercises.

Figure 7:
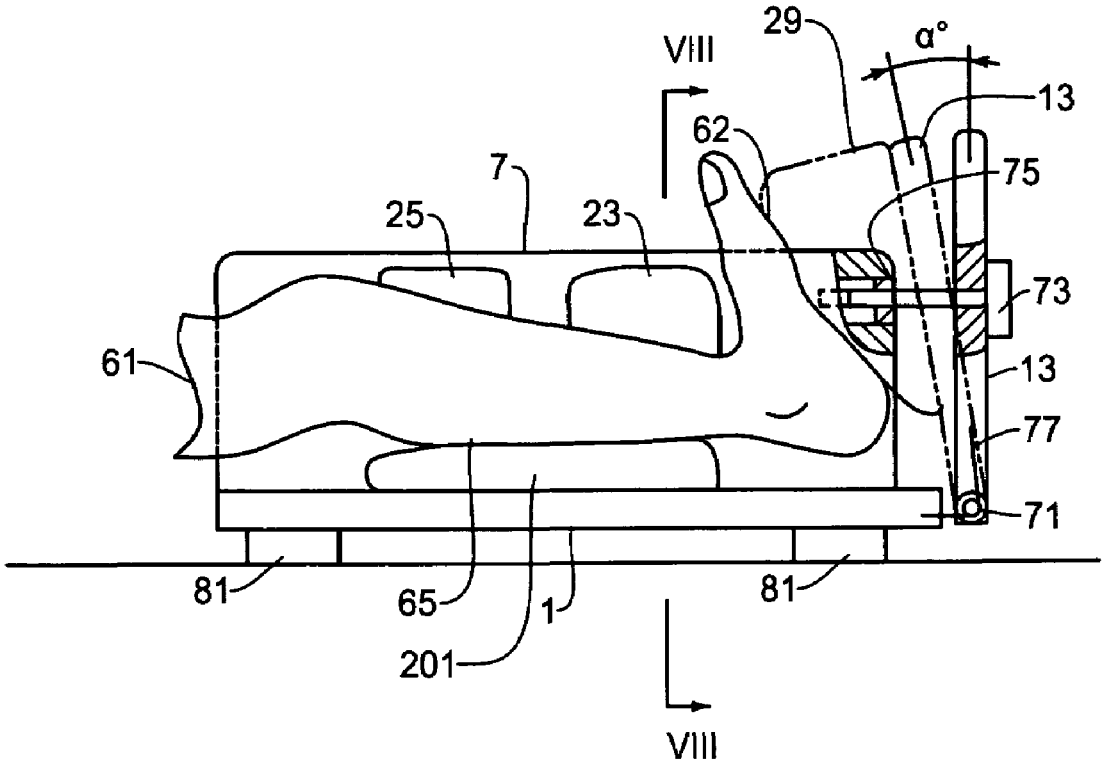
FIG. 7 is a cross sectional side view of the exercise apparatus in the fourth embodiment of the present invention.
Figure 8:
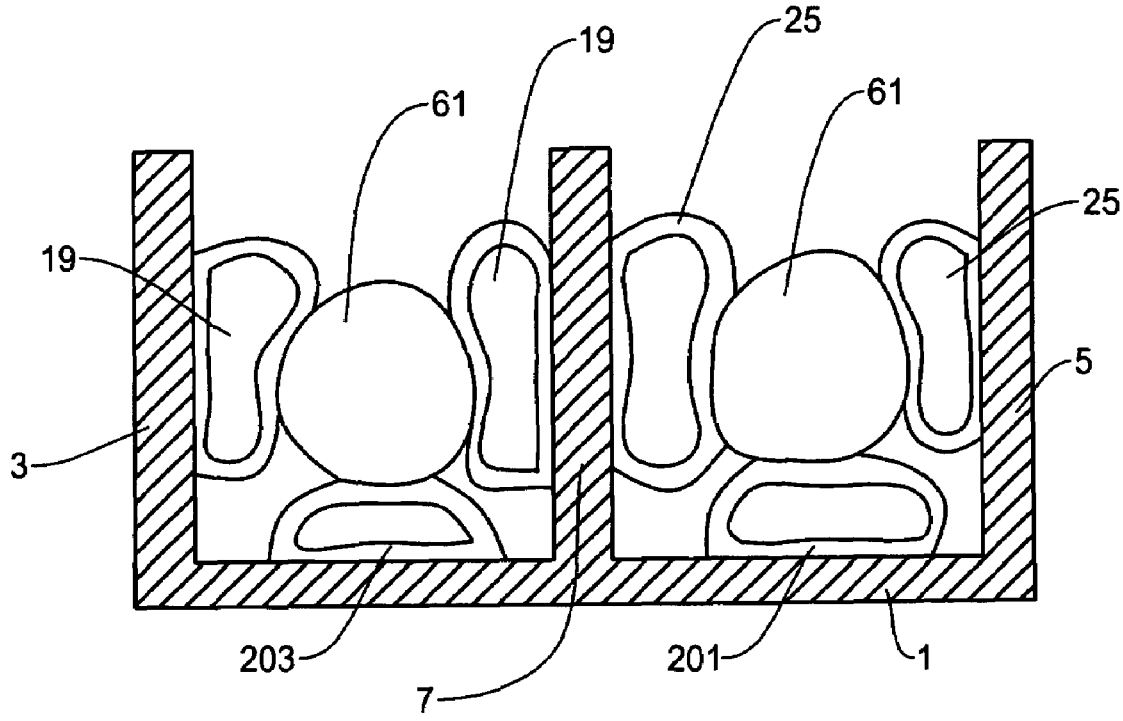
FIG. 8 is a cross sectional view of the exercise apparatus in the fourth embodiment of the present invention taken along the VIII—VIII line of FIG. 7.

FIGS. 7 and 8 show the exercise apparatus in the fourth embodiment of the present invention. FIG. 7 is a side view of the exercise apparatus and FIG. 8 is a cross sectional view taken along the VIII—VIII line of FIG. 7. In the first, second, and third embodiments noted above, no air bags are incorporated under the calves 65. In the fourth embodiment, however, air bags 201 and 203 are provided on the inner surfaces of the frame 1 (leg receiving units 9 and 11) under the calves 65 of the user. The air bags 201 and 203, as shown in FIGS. 7 and 8, are structured to inflate under the calves 65, and are preferably shaped to fit the shape of the calves 65.

By providing such air bags 201 and 203, the legs below the knees, particularly the calves 65, are even more securely supported in the exercise apparatus. In other words, many users have different sized calves 65, thus, a user with small calves cannot securely fix his feet in the exercise apparatus, resulting in less effective stretch effects. By the constriction of the air bags 201 and 203, however, such ineffectiveness can be eliminated in the fourth embodiment of the present invention.

As for the timings of inflation of the air bags in the exercise apparatus, first, the pair of air bags 17 and the pair of air bags 23 at the ankles are inflated. Then, the pair of air bags 19 and the pair of air bags 25 at the sides of the calves are inflated, and lastly, the air bags 27 and 29 at the soles are inflated. The air bags 201 and 203 under the calves are preferably inflated at the same time when inflating the pair of air bags 19 and the pair of air bags 25.

Figure 9:
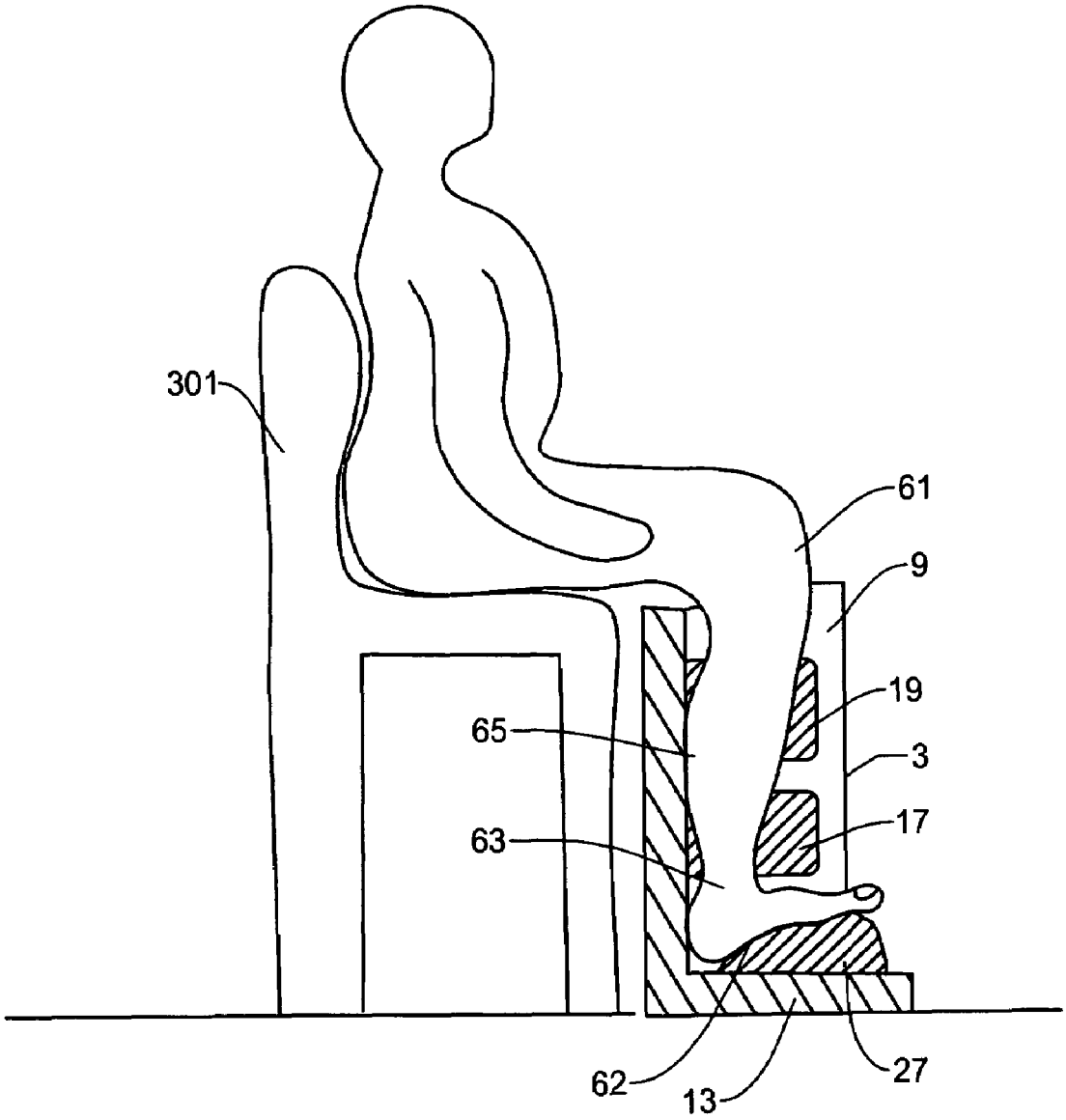
FIG. 9 is a side view with partial cross section of the exercise apparatus in the fifth embodiment of the present invention showing how the exercise apparatus is used while a user is sitting on a chair.

FIG. 9 shows the exercise apparatus in the fifth embodiment of the present invention. The first through the fourth embodiments have been explained based on the way of using the exercise apparatus while the user is lying on the back. In the fifth embodiment, as shown in FIG. 9, the exercise apparatus is used while the user is sitting on a chair. In the example of FIG. 9, the exercise apparatus has the same structure described with respect to the first embodiment. However, any exercise apparatus described above can be equally used when the user is sitting on the chair.

Figure 10A:
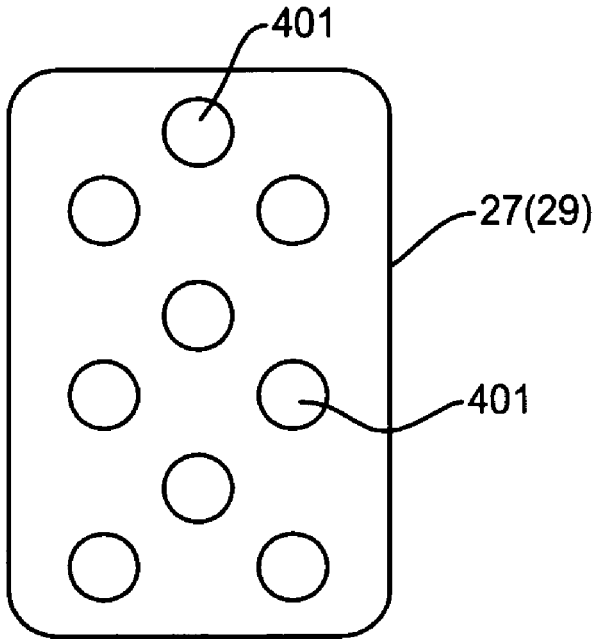
FIGS. 10A and 10B are schematic diagrams showing the air bags used in sole pressing means in the exercise apparatus in the sixth embodiment, where
Figure 10B:
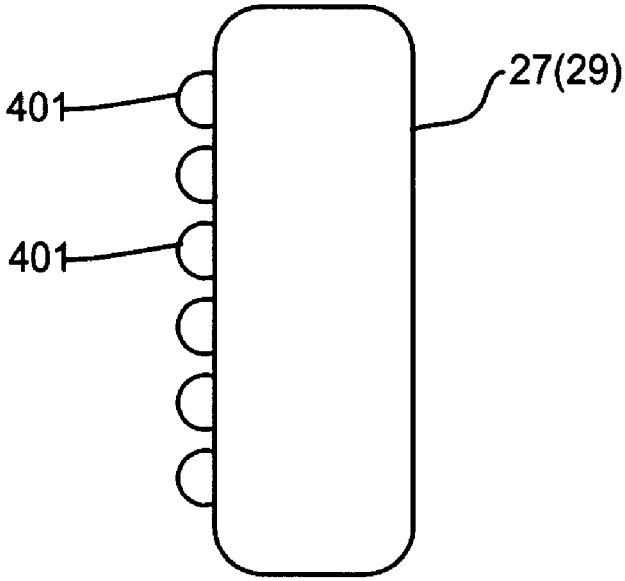

Next, the sixth embodiment of the present invention will be explained with reference to FIG. 10. In this embodiment, the surfaces of the sole pressing air bags 27 and 29 in the foregoing embodiments are provided with protrusions or bumps to stimulate (press) the therapeutic points of the soles. For example, each protrusion 401 has a diameter of 10–30 mm. Such protrusions 401 can stimulate the therapeutic points on the soles and achieve better blood circulation.

Such protrusions are not limited to the sole pressing air bags 27 and 29, but can also be provided on other air bags as well.

The present invention has been described with respect to the first to sixth embodiment, however, the present invention is not limited to those embodiments. For example, it should be noted that instead of the air bags and compressed air, other types of bags and fluids can also be used. For example, compressed oil or other liquid can be used to inflate or deflate the bags prepared for such liquid.

Further, various supporting means and pressing means other than the air bags, such as mechanical components and moving mechanism can be incorporated. Also, the locations for fixing the legs are not limited to the ankles and calves as described above, and thus, can be freely set when producing the exercise apparatus. Further, the frame itself can be so structured to incline and/or adjust the height thereof.

According to the exercise apparatus of the present invention, the user can stretch his Achilles tendons while sitting on a chair or lying on his back. In addition to the stretch exercises, the present invention can also massage the ankles and calves to achieve greater stretch results. By selectively pressing and supplying the fluid to the bags to stabilize legs and apply the pressure to the legs, the present invention can effectively operate regardless of the difference in the leg width and length. Two or more bags or air bags are piled together, the range of pressing movements can be increased, thereby achieving greater stretch results.

Further, since the protrusions are provided on the air bags, the therapeutic points can be stimulated to improve blood circulation. Further, since the height of the frame under the heel is structured to be adjustable, the pressure to the soles from the pressing means increases upon increasing the height of the frame. Moreover, since the vertical angle of the sole pressing means is adjustable, the pressure applied to the soles increases by inclining the sole pressing means towards the direction for stretching the Achilles tendons.

Although the invention is described herein with reference to the preferred embodiment, one skilled in the art will readily appreciate that various modifications and variations may be made without departing from the spirit and scope of the present invention. Such modifications and variations are considered to be within the purview and scope of the appended claims and their equivalents.

What is claimed is:

1. An exercise apparatus comprising:

a portable frame that can be freely carried around, said portable frame comprising two side walls facing each other, a back wall perpendicular to said side walls, and a partition wall at about a center of said two side walls which create a space to receive a user's leg below knee therein;

a leg supporting inflatable bag provided on either said side wall or said partition wall of said frame which presses the user's leg by inflating when compressed fluid is supplied thereto; and a sole pressing inflatable bag provided at a bottom of said frame which presses a sole of the user in a direction to stretch user's Achilles tendon by inflating when compressed fluid is supplied thereto;

wherein said leg supporting bags and said sole pressing bag can be operated at the same time.

2. An exercise apparatus as defined in claim 1, wherein said leg supporting bag has an opening to receive said compressed fluid and stores said fluid therein, an amount of said fluid supplied thereto is adjustable, thereby supporting user's legs with different sizes and shapes within said frame.

3. An exercise apparatus as defined in claim 2, further comprising an air pump connected to said leg supporting bag and the sole pressing bag to supply an compressed air to said leg supporting bag and said sole pressing bag.

4. An exercise apparatus as defined in claim 2, wherein said leg supporting bag has a size and shape to fit with ankles and calves of the user in said frame, thereby stabilizing the user's leg within the frame when said compressed fluid is supplied thereto.

5. An exercise apparatus as defined in claim 4, wherein said sole pressing bag has a size and a shape to fit with the sole of the user in said frame so as to press the sole of the user in the direction to stretch the Achilles tendon when the compressed fluid is supplied thereto.

6. An exercise apparatus as defined in claim 1, further comprising a sole supporting wall on which said sole pressing bag is mounted.

7. An exercise apparatus as defined in claim 6, wherein said sole pressing bag on said sole supporting wall applies pressure to the user's sole upon receiving the compressed fluid from a compressor.

8. An exercise apparatus as defined in claim 1, wherein said partition wall creates two spaces on said frame between said side walls and said partition wall, each space receiving one leg, wherein the leg supporting bag and the sole pressing bag are separately provided for each space.

9. An exercise apparatus as defined in claim 1, further comprising a controller box which controls an overall operation of the exercise apparatus and has a circuit board which transmits electric signals for operations of the exercise apparatus, a chamber which generates the compressed fluid, and a valve which controls flow of the compressed fluid.

10. An exercise apparatus as defined in claim 9, wherein said circuit board has a timer circuit that sets time for defining stretch time of the user's leg.

11. An exercise apparatus as defined in claim 9, wherein said valve is separately provided for each leg support bag and sole pressing bag.

12. An exercise apparatus as defined in claim 1, said back wall of said frame is flat and the surface of said back wall is configured to be placed on a ground.

* * * * *